United States Patent [19]

Lebet et al.

[11] 4,001,579

[45] Jan. 4, 1977

[54] DEVICE FOR CONTROLLING COMPOSITE CIGARETTE FILTER RODS

[75] Inventors: Jean-Pierre Lebet, Montreux; Joel Ducommun, Chavannes, both of Switzerland

[73] Assignee: Baumgartner Papiers S.A., Switzerland

[22] Filed: Mar. 10, 1975

[21] Appl. No.: 557,028

[30] Foreign Application Priority Data

Mar. 13, 1974 Switzerland ..... 3484/74

[52] U.S. Cl. ..... 250/223 R; 93/1 C; 250/227; 250/572

[51] Int. Cl.[2] ..... G01D 21/04

[58] Field of Search ..... 93/1 C; 250/223, 224, 250/227, 559, 562, 571, 572; 19/.25, .26

[56] References Cited

UNITED STATES PATENTS

| | | | |
|---|---|---|---|
| 2,896,636 | 7/1959 | Powell et al. | 250/223 R X |
| 3,334,240 | 8/1967 | Black | 250/223 R |
| 3,854,587 | 12/1974 | McLoughlin | 250/562 X |

*Primary Examiner*—Leon Gilden
*Attorney, Agent, or Firm*—Robert E. Burns; Emmanuel J. Lobato; Bruce L. Adams

[57] ABSTRACT

Faults in a composite filter rod being supplied to a sectioning device are detected optically by traversing the rod with a beam of light supplied along a first fiber bundle and taken up and delivered to photo-detector by a second fiber bundle. The ends of the cylindrical fiber bundles are held in the configuration of narrow homothetic rectangles transverse to the direction of feed of the rod, the width of the first bundle being approximately double that of the second bundle. The photo-detector controls elimination of faulty tips after sectioning; additional pairs of fiber bundles can be used to control synchronization of cutting with feed of the rod, and the correct succession of filter elements in the rod.

7 Claims, 3 Drawing Figures

DEVICE FOR CONTROLLING COMPOSITE CIGARETTE FILTER RODS

BACKGROUND OF THE INVENTION

The invention relates to the control of composite filter rods prior to sectioning of them into, for example, cigarette filter tips.

The automatic, continuous manufacture of composite filters, i.e., filters comprising two or more distinct elements, generally takes place by placing filter elements end-to-end on a moving band of paper passing through a wrapping and sealing or glueing device to form a rod which is then cut into sections each forming a filter unit or tip. The filter elements may for example be plugs of different nature, or hollow plastics material bodies which may or may not contain granules and are placed between two plugs of paper or another material. Such filters and their manufacture are described for example in U.S. Pat. Nos. 3,551,256 and 3,610,112. However, it can happen that a filter element is missed out and produces a gap in the rod, which cannot be visually observed through the opaque envelope. The rods may also have other faults such as spaces left between adjacent plugs which should be contiguous, or cavities which are insufficiently filled with granules of carbon, for example.

An aim of the invention is to provide a device for detecting such faults in filter rods after the formation thereof and as they are fed towards a sectioning device, to enable elimination of faulty sections immediately after sectioning without having to interrupt or slow feed of the rod.

A gap of 0.5 mm in a filter rod is considered as an inacceptable fault, and it is consequently an aim of the invention to provide a control device that may be constructed and arranged to operate to such a precision, and to react rapidly.

In existing machines, the detection of faults in the filter rod must in general be carried out in a very restricted space, and a further aim of the invention is to enable this condition to be satisfied.

SUMMARY OF THE INVENTION

According to the invention there is provided, in a filter manufacturing machine in which an elongate composite filter rod is passed along a given path longitudinally of the rod, a control device comprising: a light source; a first elongate optical fiber bundle receiving light from the source to transmit a beam of light along the fibers from the source to a free end of the first bundle; photo-detection means; a second elongate optical fiber bundle leading to the photo-detection means and having a free end receptive of light to transmit a beam of received light along the fibers to the photo-detection means; and means for holding said free ends of the first and second bundles in the proximity of said path in an alignment to direct said beam of light from the free end of the first bundle through the rod and into the free end of the second bundle.

The use of elongate light conductors formed as fiber bundles allow a great freedom in location of the light source and the detection means in the machine.

BRIEF DESCRIPTION OF THE DRAWINGS

The accompanying schematic drawings show, by way of example, an embodiment of the invention. In the drawings.

DESCRIPTION OF A PREFERRED EMBODIMENT

Figures 1, 2, 3:
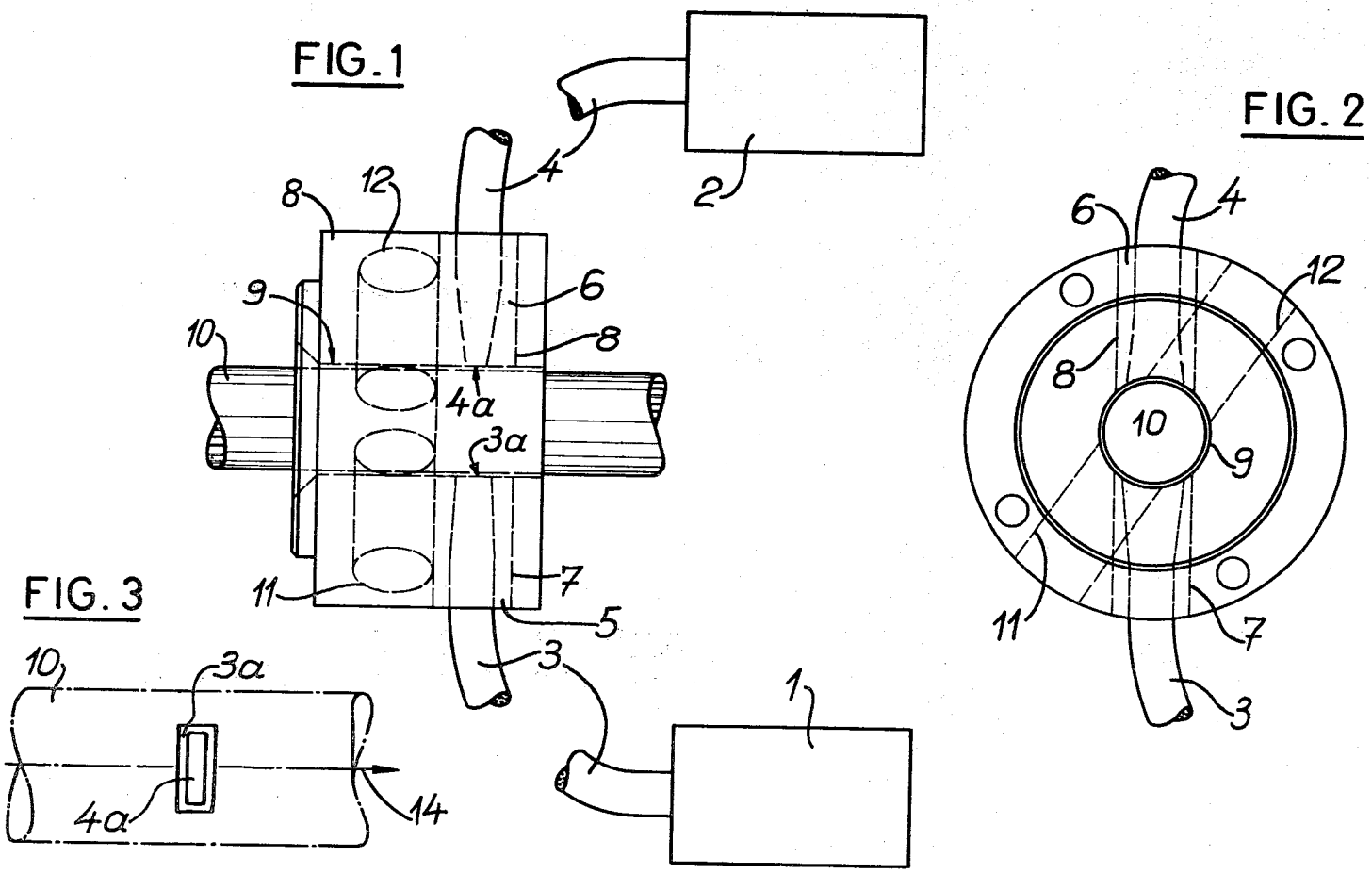
FIG. 1 is a side elevational view of the control device.
FIG. 2 is an end elevational view of part of the device.
FIG. 3 schematically shows, on an enlarged scale, and in a view at right angles to FIG 1, the ends of the light conductors.

The device comprises a light source 1 and a photo-electric detection device 2, both schematically shown. Light from source 1 is received by an optical fiber bundle 3 which delivers and emits a beam of light, received by the end of a second fiber bundle 4 connected to the photo-detection device 2. The ends of bundles 3 and 4 are gripped in respective metallic sleeves 5 and 6 fixed in radial cylindrical bores 7 and 8 in an annular support 8. This support is in the form of a body of a polymeric resin which does not reflect light, and has an axial through-bore 9 whose diameter is slightly greater than the diameter of a filter rod 10 which is thus able to pass freely through support 8.

A second pair of radial bores 11 and 12 are provided in support 8 to receive the ends of a further pair of emitting and receiving fiber bundles, not shown. This second pair of fiber bundles may be used either for synchronization of the cutting of rod 10 with the speed of feed of the rod, or for the control of the correct succession of filter elements, as will be described later.

FIG. 3 shows the ends 3*a* and 4*a* of the emitting and receiving fiber bundles. Each end has a rectangular configuration, as seen transversely to the direction of feed 14 of rod 10. These rectangles are relatively narrow along direction 14. As shown, they are symetrical with one another along direction 14. They are also shown symmetrical with one another at right angles to direction 14; they are homothetic. The actual widths of ends 3*a* and 4*a* along direction 14 about 1 mm and 0.5 mm respectively.

The rectangular sections are obtained by flattening the ends of the otherwise cylindrical fiber bundles. The described arrangement of the ends of the emitting and receiving fiber bundles thus involves a concentration of the internal longitudinal fibers over a slight width along direction 14. This enables the provision of a detected signal which is clearer and of greater amplitude, i.e., of better definition than if the ends of the bundles were not so concentrated, and were for example; circular. The fact that the light-receiving end 4*a* is narrower than the emitting end 3*a* also appreciably improves the definition. For example, if there is a relatively narrow gap in the rod 10, equal to the width of end 4*a*, at a given moment all of the optical fibers of bundle 4 will simultaneously receive light passing through this gap, whereas if the fibers were arranged over a wider section, the beam of light would sweep over the end of bundle 4 and produce a flattened pulse. The particular arrangement thus provides a narrower and larger pulse and hence a received signal of greater precision. The arrangement of the ends of the optical fibers in narrow rectangular sections also reduces the influence of any low efficiency fibers in a bundle since these are practically certainly aligned transversally with high efficiency fibers. As support 8 does not reflect light, there are no stray reflexions to perturb the detection.

The photo-electric detection device 2 controls, via an amplifier, not shown, a device for selectively ejecting the sectioned filter tips, also not shown.

In the case of composite filters having a cavity filled with granules of carbon, for example, the control device should be arranged to distinguish between an empty space due to faulty juxtapositioning of filter elements, and a cavity filled with granules. The threshold of the detection means can be adjusted to actuate a controlled ejection device (not shown) in response to either a faulty juxtapositioning of filter elements, or an incorrect succession of filter elements, or when a cavity is incorrectly filled with granules. The precision will of course depend on the degree of definition of the electronic detection means. An ejection may be actuated when an insufficient density of granules results from either an insufficient quantity of granules, or the cavity being too large.

It is also essential to section the rod at the correct location, to ensure that all of the filter tips are identical and usable. However, even after a careful initial setting of synchronization of feed of the rod and the sectioning device, dephasing can occur, either because of a variation in the supply of filter elements, or variation in the speed of feeding the rod. The device according to the invention can be used to maintain synchronization between feed of the rod and sectioning. For this purpose, use is made not of the signal emitted by device 2, which controls ejection, but of a signal produced by a second pair of fiber bundles whose ends are fixed in bores 11 and 12 of support 8. These bundles must not only detect the passage of a gap, or a filled cavity, but a difference of structure between the consecutive filter elements in a manner to be able to localize the filter tips and control possible correction of synchronization of the sectioning, for example by means of a servomotor. This is possible since a luminous signal can be detected through the filter rod, the "density" of the light received depending on the material, e.g. plugs of paper, cellulose, cellulose acetate and so on.

It is also possible to provide a resynchronization by employing as parameters the length of the filter tips or one of their elements and the speed of feed of the rod which is measured by appropriate means.

The fiber bundles whose ends are fixed in bores 11 and 12 of support 8, or a third pair of such bundles, can be used to control the correct succession of the elements of the composite filters in the rod. The composite filters are formed of different elements supplied from two or more distributors, and these elements must be delivered in a given order, either alternately, or with two identical elements delivered successively.

If this sequence is not adhered to, there is a fault even if the elements are juxtaposed without any gaps, and the defective filter tip must be eliminated. To detect such a fault, the detection means can be arranged not only to distinguish the various types of filter elements, but also to compare the signal received with a reference value corresponding to the filter element which should pass a given instant between the facing ends of the respective bundles. If the received signal does not correspond to the reference value, the resulting filter tip is ejected.

It is also possible to record the succession of signals received for a tip in the rod and compare this with a reference "image". Recordal and comparing can be readily carried out by means well known to persons skilled in the art.

What is claimed is:

1. A control device for a filter manufacturing machine, comprising;

means for passing an elongate composite fiber rod along a path longitudinal of the rod;

a light source having a first elongate optical fiber bundle receiving light from the source to transmit the received light along the fibers from the source to and through a free end of the first bundle into the rod;

photo-detection means having a second elongate optical fiber bundle leading to the photo-detection means, from a free end of the second bundle receptive of incident light to transmit the incident light to the photo-detection means, the free end of the second bundle extending over a lesser width along said path than the free end of the first bundle thereby enabling detection of a clearer and greater amplitude light signal; and means for holding the free ends of the first and second bundles adjacent said path, opposite one another, to direct said light from the source through the first bundle into and through an inside portion of the rod, and, as incident light from the composite rod and responsive to a composition of the inside portion thereof, into and through the second bundle and to the photo-detection means for actuating a controlled device in response to said composition.

2. A control device according to claim 1, additionally including a pair of elongate fiber bundles generally similar to the first and second bundles, for controlling a succession of elements of the composite fiber rod.

3. A control device according to claim 1, additionally including a pair of elongate optical fiber bundles generally similar to the first and second bundles, for detecting a discontinuity in the filter rod to ensure synchronization of sectioning of the rod.

4. A control device according to claim 1, in which the means for holding the free ends of the fiber bundles comprises a body of a polymeric resin which is nonreflective to light and has a through bore to provide the path for the filter rod.

5. A control device for a filter manufacturing machine, comprising;

means for passing an elongate composite filter rod along a path longitudinal of the rod;

a light source having a first elongate optical fiber receiving light from the source to transmit the received light along the fibers from the source to and through a free end of the bundle into the rod, said free end being disposed in a plane parallel to said path and having a rectangular configuration elongated transversely of said path;

photo-detection means having a second elongate optical fiber bundle leading to the photo-detection means from a free end of said bundle receptive of incident light to transmit the incident light to the photo-detection means, the free end of the second bundle having an elongate rectangular configuration generally similar to that of the free end of the first bundle, except for a lesser width along said path thereby enabling detection of a clearer and greater amplitude light signal; and means for holding the free ends of the first and second bundles adjacent said path, opposite one another to direct said light from the source through the first bundle, through an inside portion of the rod, and, as incident light from the composite rod and responsive to a composition of the inside portion thereof, into and through the second bundle and to the photo-detection means for actuating a controlled device in response to said composition.

6. A control device according to claim 5 in which said rectangular configurations of the free ends of the fiber bundles are symmetrical with one another, along said path.

7. A control device according to claim 6, in which said configurations of the free ends of the first and second bundles are homothetic rectangles whose dimensions are approximately in the ratio 1:2.

* * * * *